US011819748B2

(12) United States Patent
Grendal

(10) Patent No.: US 11,819,748 B2
(45) Date of Patent: Nov. 21, 2023

(54) PUNCHWRAP

(71) Applicant: Matthew Grendal, La Jolla, CA (US)

(72) Inventor: Matthew Grendal, La Jolla, CA (US)

( * ) Notice: Subject to any disclaimer, the term of this patent is extended or adjusted under 35 U.S.C. 154(b) by 429 days.

(21) Appl. No.: 17/129,122

(22) Filed: Dec. 21, 2020

(65) Prior Publication Data

US 2021/0220717 A1 Jul. 22, 2021

Related U.S. Application Data

(63) Continuation-in-part of application No. 29/759,698, filed on Nov. 24, 2020.

(60) Provisional application No. 62/964,060, filed on Jan. 21, 2020.

(51) Int. Cl.

| | |
|---|---|
| ***A63B 69/20*** | (2006.01) |
| ***A63B 71/12*** | (2006.01) |
| ***A63B 71/14*** | (2006.01) |

(52) U.S. Cl.

CPC ..... *A63B 69/20* (2013.01); *A63B 71/12* (2013.01); *A63B 71/145* (2013.01); *A63B 2071/1208* (2013.01); *A63B 2210/50* (2013.01); *A63B 2244/10* (2013.01); *A63B 2244/102* (2013.01)

(58) Field of Classification Search

CPC ..... A63B 69/004; A63B 69/26; A63B 69/20; A63B 69/206; A63B 69/28; A63B 69/305; A63B 2071/1208; A63B 71/12; A63B 2210/50; A63B 2244/102

See application file for complete search history.

(56) References Cited

U.S. PATENT DOCUMENTS

| | | | | | |
|---|---|---|---|---|---|
| 1,685,495 | A * | 9/1928 | Latz | A63B 69/30 | 223/67 |
| 4,667,954 | A * | 5/1987 | McCorkle | A63B 69/26 | 482/86 |
| 5,501,649 | A * | 3/1996 | Queppet | A63B 69/26 | 482/88 |
| 6,063,011 | A * | 5/2000 | Pelchat | A63B 69/305 | 482/90 |
| 8,641,584 | B2 * | 2/2014 | Jang | A63B 24/0062 | 482/84 |
| 2017/0189726 | A1 * | 7/2017 | Parrish | A61G 1/013 | |
| 2019/0314707 | A1 * | 10/2019 | Lemieux | A41D 13/0562 | |
| 2021/0220717 | A1 * | 7/2021 | Grendal | A63B 71/145 | |

* cited by examiner

*Primary Examiner* — Joshua T Kennedy
(74) *Attorney, Agent, or Firm* — Buche & Associates, P.C.; John K. Buche; Bryce A. Johnson

(57) ABSTRACT

A punching bag that can transform into body armor for fighter training. In particular, the punching bag can be used as a heavy bag or body armor. The punching bag can be hung up from a support, strung up between an upper support and a lower support, or worn on a person.

1 Claim, 14 Drawing Sheets

PUNCHWRAP

CROSS-REFERENCE TO RELATED APPLICATIONS

This specification claims the benefit and priority of U.S. Prov. App. Ser. No. 62/964,060. This application is also a divisional of U.S. Des. Pat. No. 29/759,698.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of mixed martial arts training equipment.

Background of the Invention

Standalone punching bags are a necessity for martial arts training. However, standalone punching bags are heavy, clunky and not versatile. Thus, a need exists for a standalone punching bag that is modular, light, easy to handle, and versatile. The solution presented to the problem of cumbersome martial arts workout equipment is called a punchwrap and acts like a heavy bag. The punchwrap allows users to attach the multiple pieces, including extra padding, to a hook and stand setup or directly to a heavy bag for the same effect. Typically, boxers and MMA fighters purchase a separate upper cut bag and padding for their workout, however, the punchwrap already includes these items so the user will may not have to purchase extra equipment.

SUMMARY OF THE INVENTION

In view of the foregoing, an object of this specification is to disclose a punchwrap. The punchwrap is designed to allow boxers and MMA fighters to practice their punching and kicking techniques without having to use a lot of large equipment. The punchwrap is to be used as a standalone item that is representative of a heavy bag. Further, the punchwrap can be adjusted to practice uppercut punches or high kicks by simply moving around a few pieces.

The punchwrap allows users to practice with a trainer and gives the trainer the option to wear a portion of the punchwrap around their body. Further, the invention allows the trainer to put the body armor over their chest area for more advanced training. The Punchwrap allows the user to put the arm padding on one's hands to simulate a glove work that typical boxers and fighters do with their trainers.

The Punchwrap is travel-friendly. The punchwrap is lightweight and fits into a compact bag for easy access and portability. The Punchwrap is meant to give the same quality of workout to a person without a gym membership or expensive equipment.

The Punchwrap is modular. The punchwrap combines two pieces of boxing equipment and has the versatility to become four different pieces of equipment for different techniques. The punchwrap is an all-in-one home gym that is easily transportable, lightweight, and versatile compared to four separate items which it replaces which are heavy and hard to set up.

The punchwrap appeals to many different demographics. The punchwrap may be used by individual athletes and owners of small gyms. Larger gyms may use the punchwrap outside of their facility, such as in a park, or on a beach.

The punchwrap provides many benefits to the user. The punchwrap is light, versatile, and portable. Further it is relatively cheap compared to other martial arts training and exercise equipment. The punchwrap is designed for home gyms and small or large training sessions. Finally, the punchwrap can be a heavy punching bag that looks like a sparing vest and, when internal components are removed, it can operate as a sparing vest.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 11:
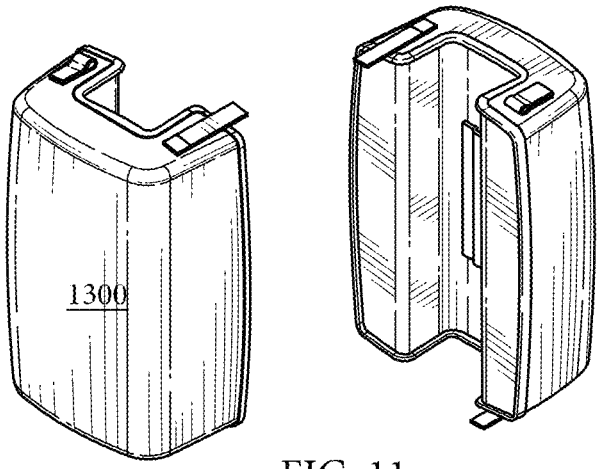
Figure 12:
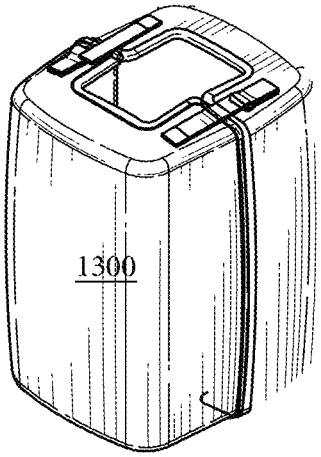
Figure 12A:
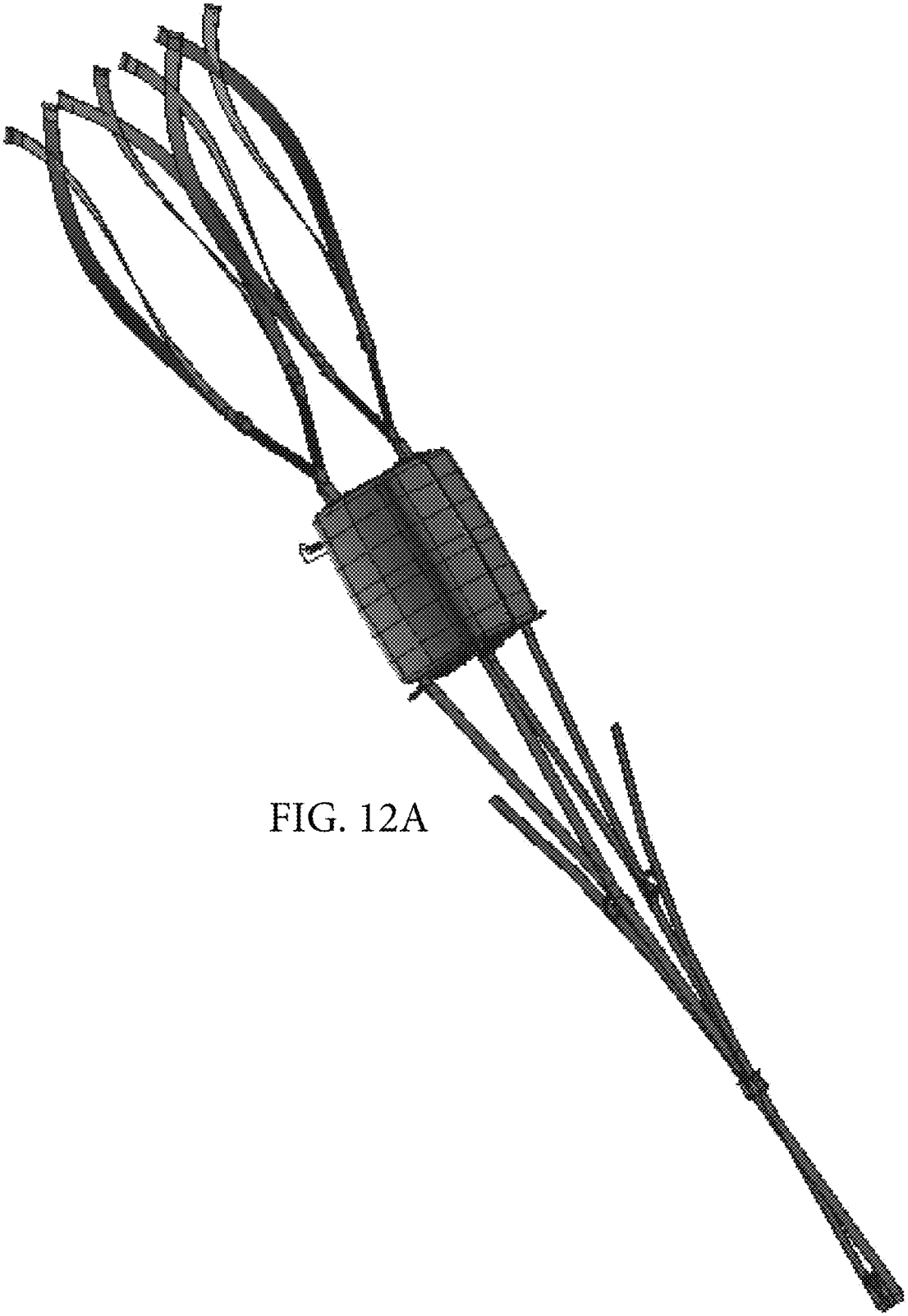
Figure 12B:
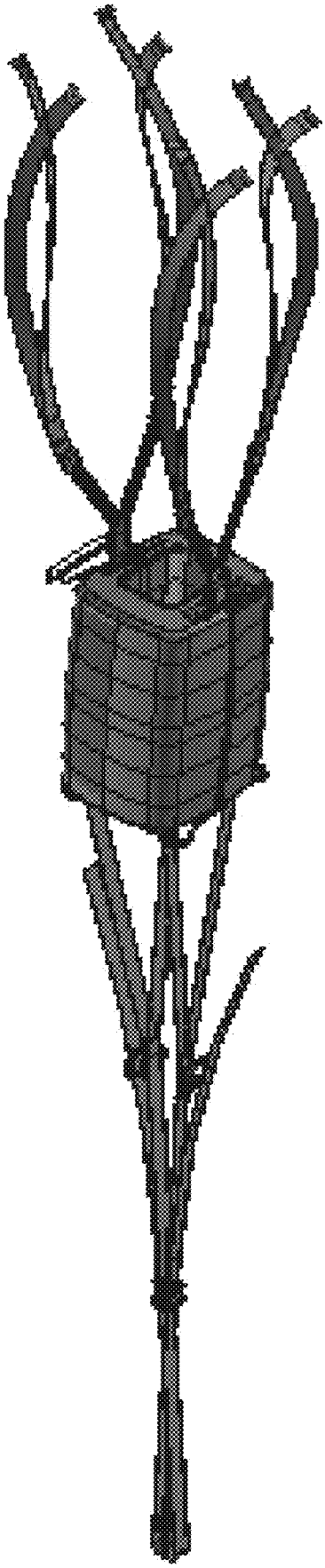
Figure 12C:
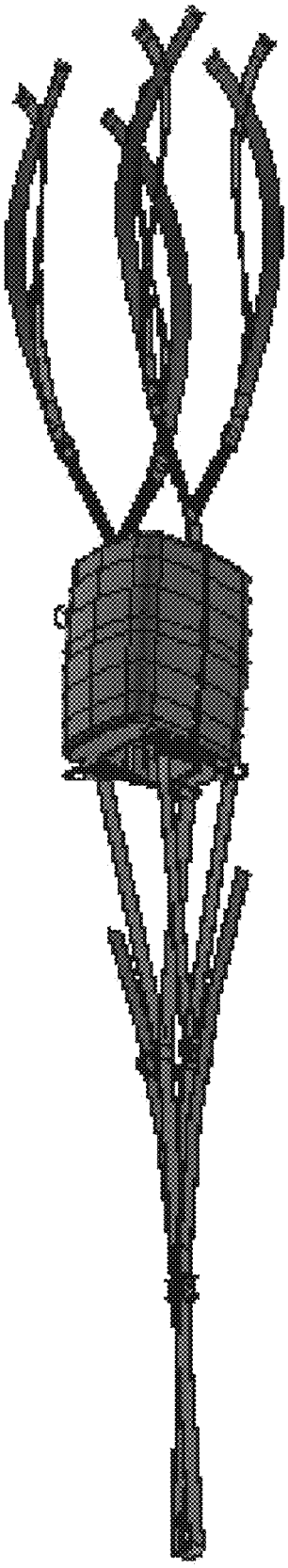
Figure 13:
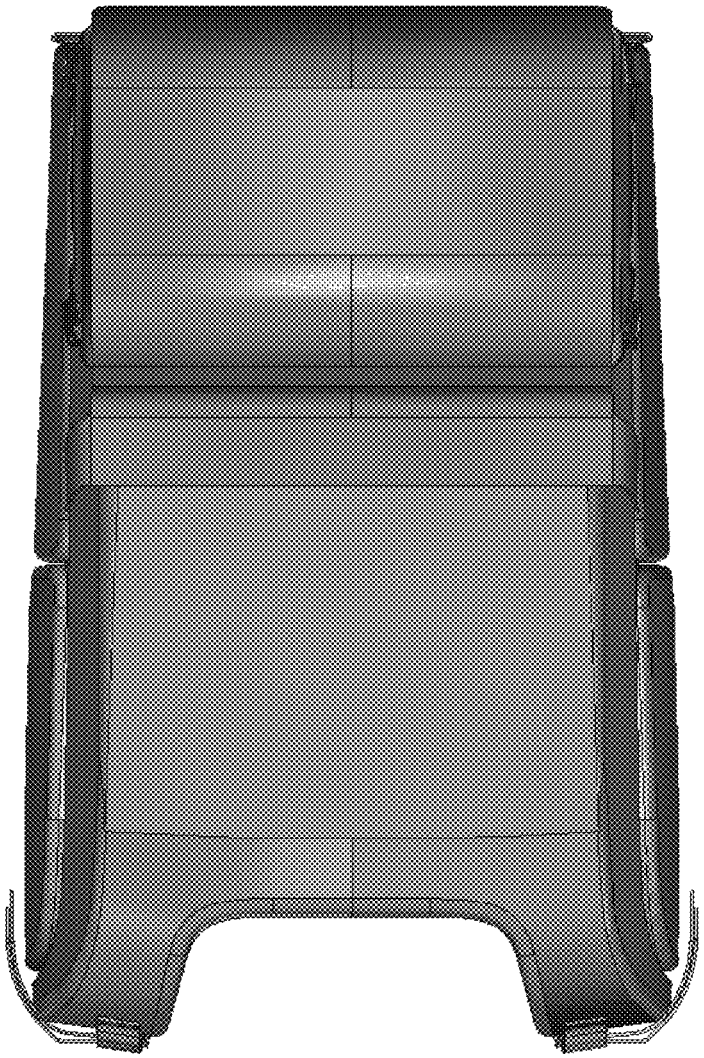
Figure 14:
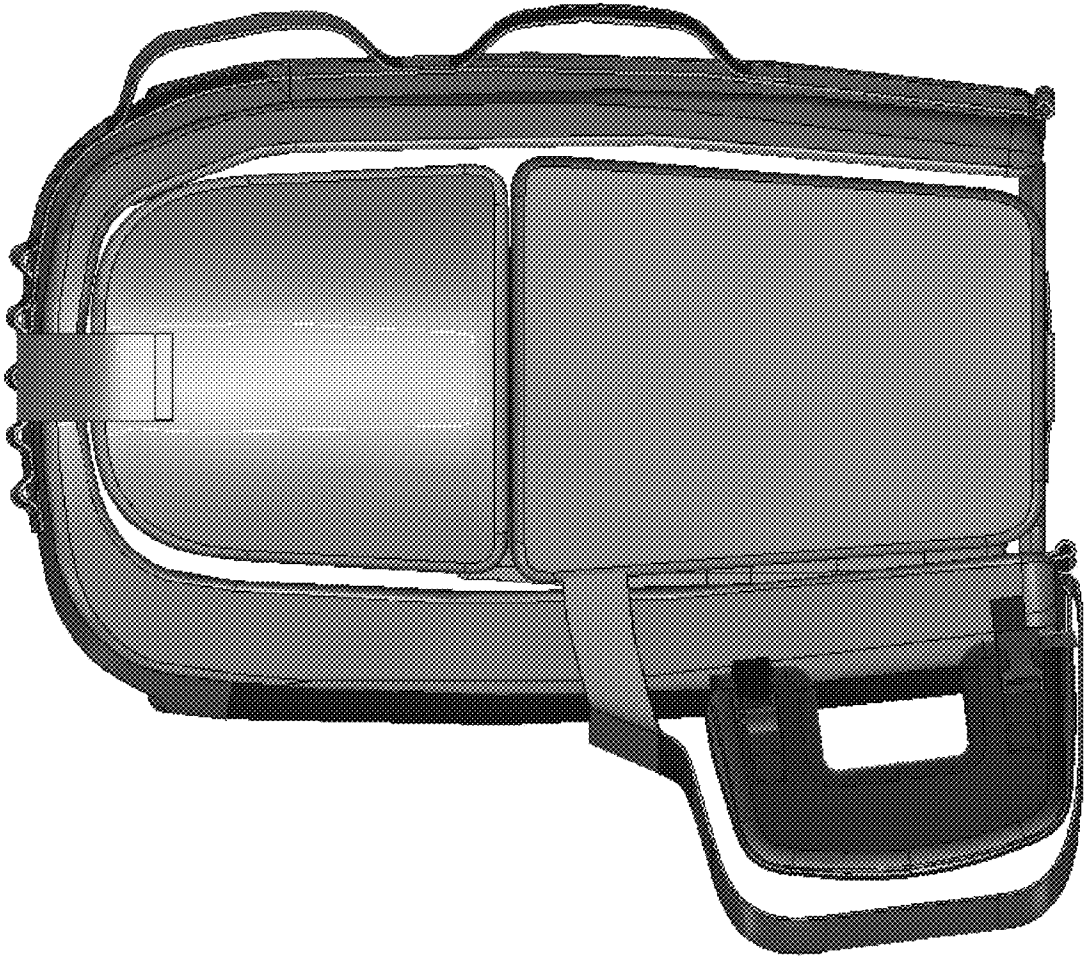
Figure 15:
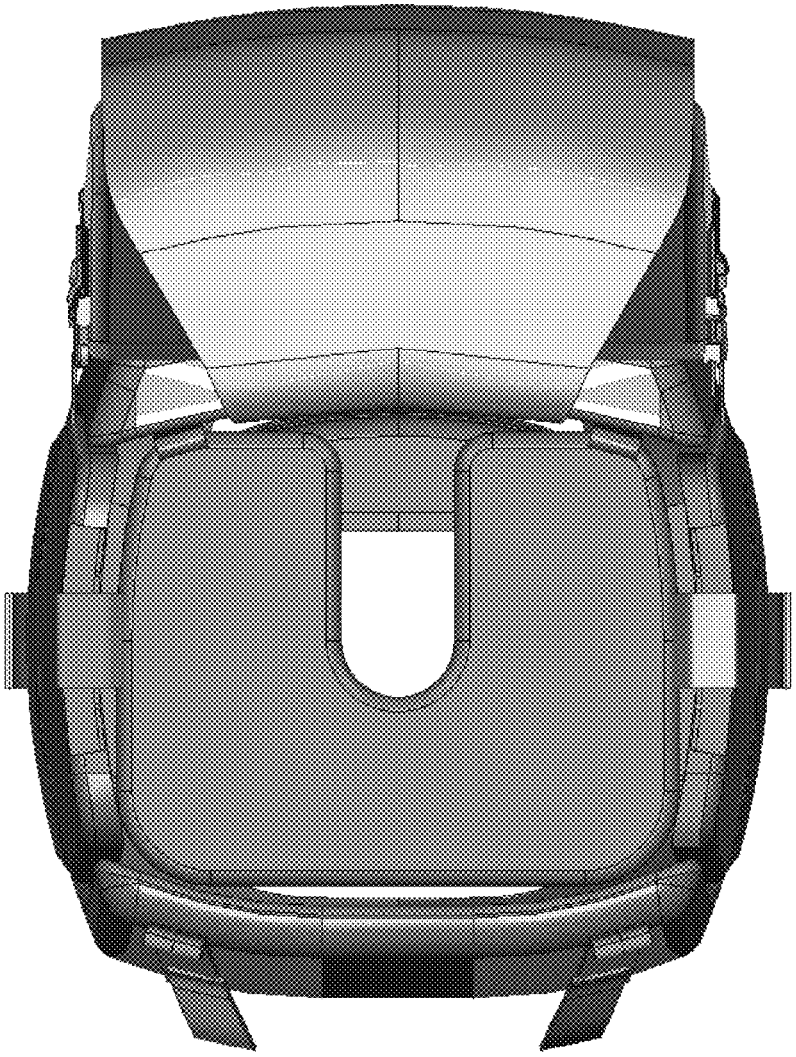

FIG. is 10 an environmental front view of how individual could wear the body padding;

FIG. 11 is an exploded view of arm padding which is used to form the cylinder, as well as, a standalone item;

FIG. 12 is a view of the assembled arm padding;

FIG. 12A is a perspective view of an assembled double ended punching bag;

FIG. 12B is another perspective view of an assembled double ended punching bag;

FIG. 12C is yet another perspective view of an assembled double ended punching bag;

FIG. 13 is a front view of an upper cut bag;

FIG. 14 is a side view of an upper cut bag; and,

FIG. 15 is a top view of the upper cut bag.

The following is a list of characters and their associated structures:

1000—punchwrap

1100—body padding

1110—front panel
1111—lower front loop
1120—rear panel
1121—lower rear loop
1130—shoulder straps
1131—upper loops
1140—shoulder pads or another set of side pads
1141—connectors
1150 side pads
1200—hand pads
1300—arm pads or double ended punching bag
2000—cords It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a training device, called a Punchwrap, that can transform from a punching bag to a set of body and arm padding which can be used in multiple ways for different training techniques. When using the Punchwrap the user may in one mode connect the two fold a body or arm padding to form a cylindrical item, creating a heavy punching bag. In some versions, there are a few different attachments that unhooks to create an uppercut bag. In other versions, the punchwrap can be used with a standard heavy bag stand by placing the cylinder on the hook and anchoring it to the ground with chords attached to a ground weight.

Figure 1:
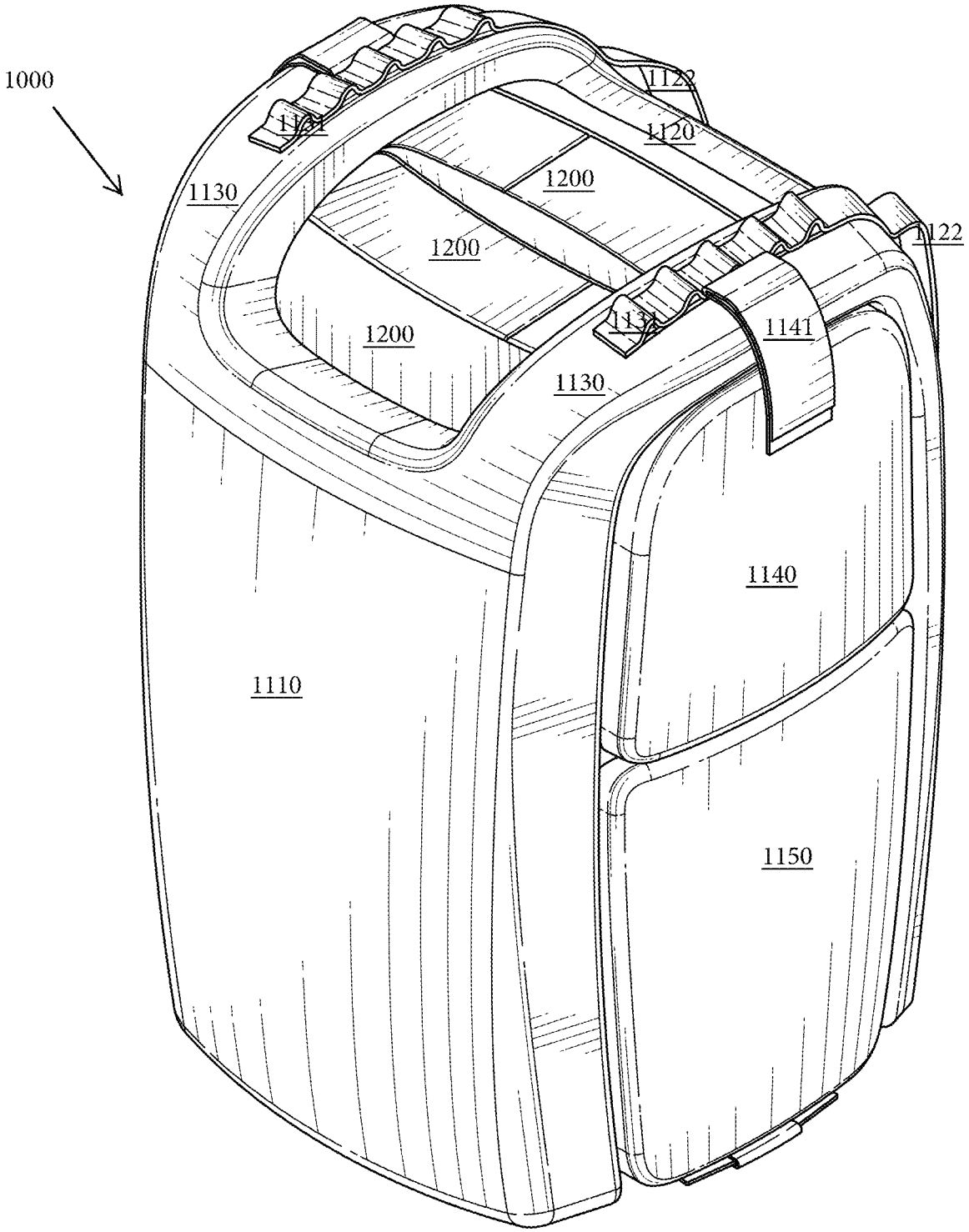
FIG. 1 is a perspective view of a heavy bag.
Figure 2:
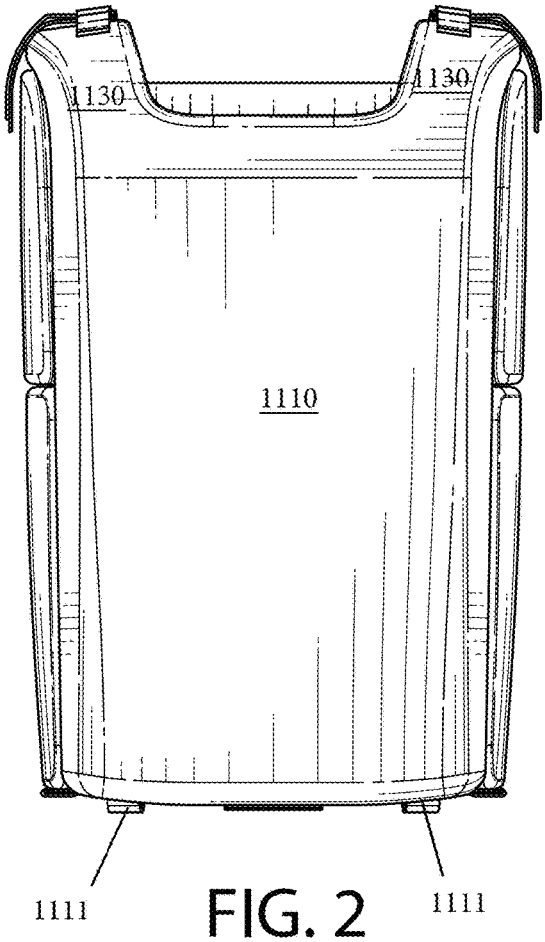
FIG. 2 is a front view of the punchwrap.
Figure 3:
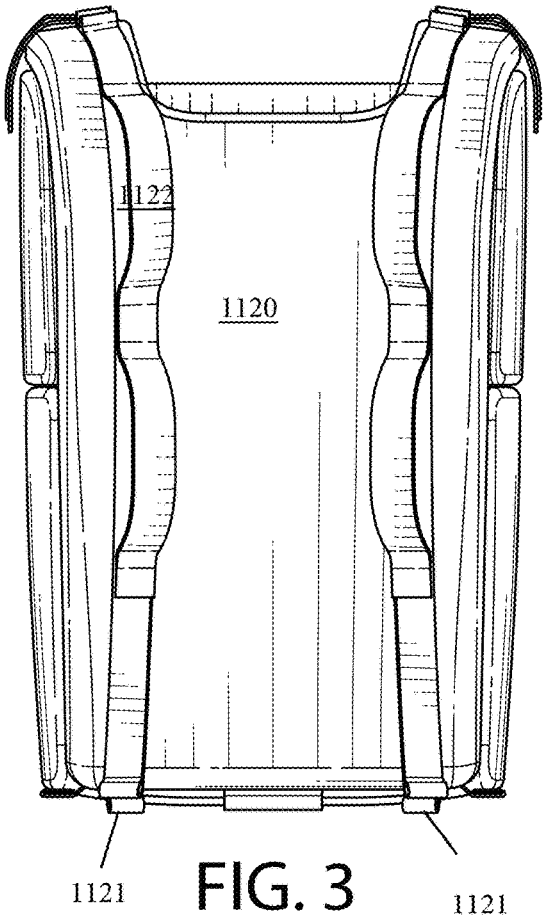
FIG. 3 is a rear view of the punchwrap.
Figure 4:
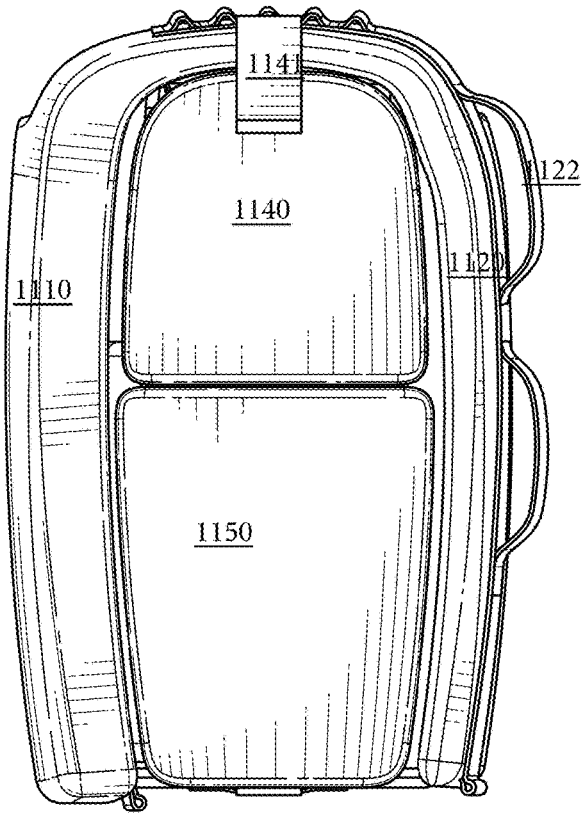
FIG. 4 is a left-side view of the punchwrap.
Figure 5:
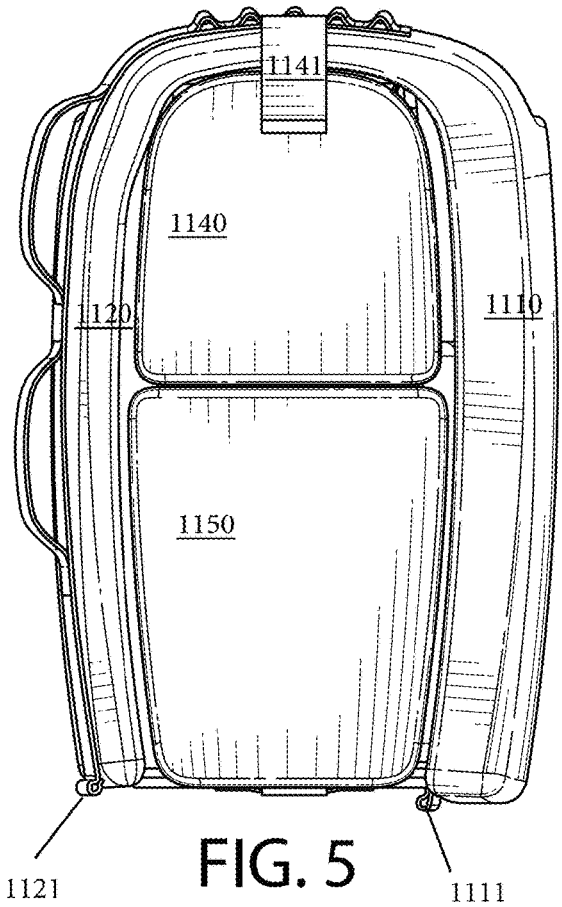
FIG. 5 is a right-side view of the punchwrap.
Figure 6:
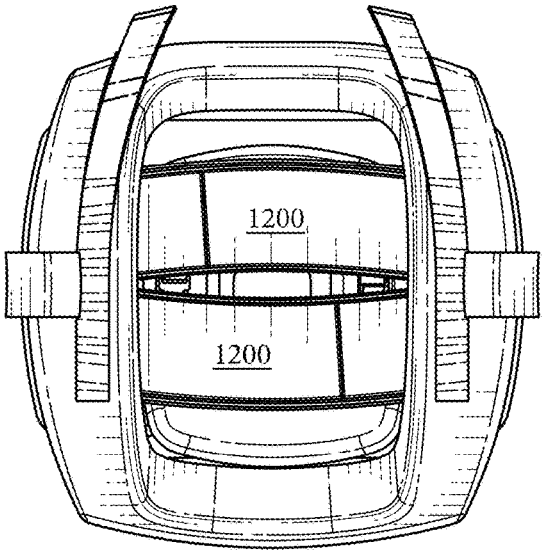
FIG. 6 is a top view of the punchwrap.
Figure 7:
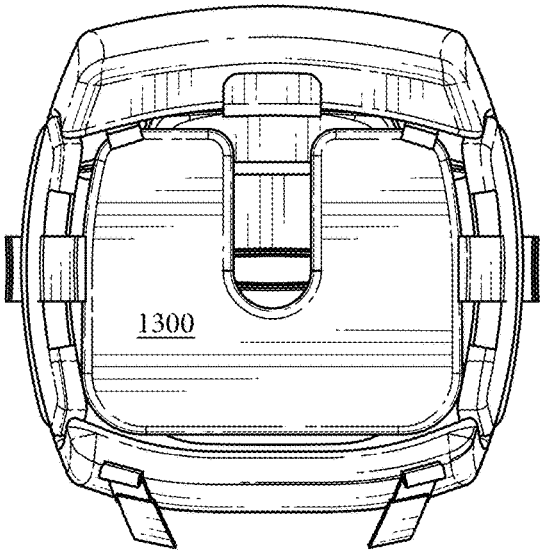
FIG. 7 is a bottom view of the punchwrap.

This disclosed subject matter takes popular pieces of fight training equipment and combines them into one manageable system. A typical heavy bag can weigh anywhere from 70 to 150 lbs and can be hard to transport and setup, whereas The Punchwrap is lightweight and compact. Uppercut bags are permanent fixtures, typically bolted into the wall, whereas The Punchwrap can become an uppercut bag using a common gym bag as an attachment. In one embodiment, the arm padding can be put on the Punchwrap to form an uppercut bag. The Punchwrap includes detachable training mitts and body armor that can be used separately or with the other attachments to create a portable heavy bag. The Punchwrap can be converted to an upper cut bag or have its parts used as a double end punching bag. The Punchwrap may give both professional fighters and individuals looking for a different type of workout the opportunity to have a full training experience, by themselves or with a partner. The details of the Punchwrap are disclosed with reference to the figures, wherein the following is a list of characters and their associated structures:

FIG. 1 is a perspective view of one configuration of the punchwrap 1000. FIG. 2 is a front view of the punchwrap 1000. FIG. 3 is a rear view of the punchwrap 1000. FIG. 4 is a left-side view of the punchwrap; FIG. 5 is a right-side view of the punchwrap; FIG. 6 is a top view of the punchwrap. FIG. 7 is a bottom view of the punchwrap 1000. As shown, the punchwrap 1000 externally features body padding (1100 FIG. 8) defined by: a front panel 1110 with lower front loops 1111; side pads or panels 1150; a rear panel 1120 defined by back straps 1122 and lower rear loops 1121; shoulder straps 1130 that connect the front an rear panels 1110,1120 and that feature upper loops 1131; and shoulder pads 1140 hung off the straps 1130 via a connector 1141. The punch wrap 1000 internally features hand pads 1200 and arm pads 1300 that are disposed between the front and rear pads 1110, 1120. Suitably, the hand and arm pads 1200, 1300 fit snugly inside the body padding (1100 FIG. 8) so that the punchwrap 1000 has an appearance and feel of solidarity of parts. Preferably, each part or padding of the body padding (1100 FIG. 8) and internal parts (hand and arm pads 1200, 1300) features foam or other padded material and or weighted material as would be common to fighting gear and regular well-known punching bags.

In the configuration shown in FIGS. 1 through 7, the punchwrap can be used as a punching bag. In one mode of use trainer may grip the handles 1122 on the rear pad 1120 and simply hold the punchwrap 100 in front of a fighter. From this lifted position, the fighter may strike the punchwrap 1000 in the front 1110 or side panels 1150 using his feet or hands. Additionally, the fighter may punch arm padding 1300 that is exposed on the underside of the punchwrap 1000 (as shown in FIG. 7). In some cases, the punchwrap 1000 may have the hand or arm pads (1200, 1300) connected externally to the front panel to convert the punchwrap 1000 into an uppercut specific punching bag (as shown in FIGS. 13 through 15). In this particular uppercut specific configuration, the punchwrap is suitably turned upside down so that the arm pads are located at an upper location as shown in FIG. 14.

Figure 8:
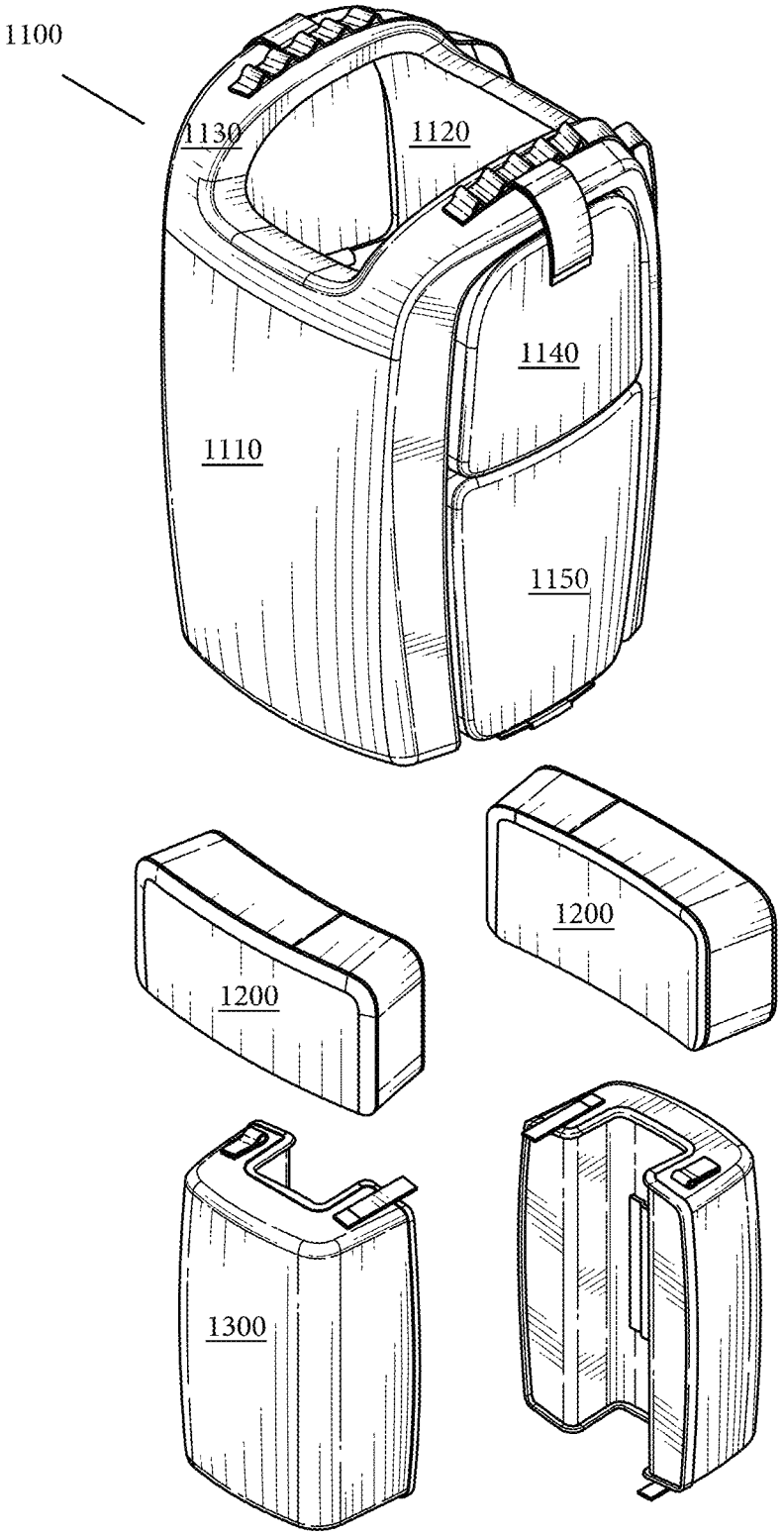
FIG. 8 is an exploded view of the punchwrap.
Figure 8A:
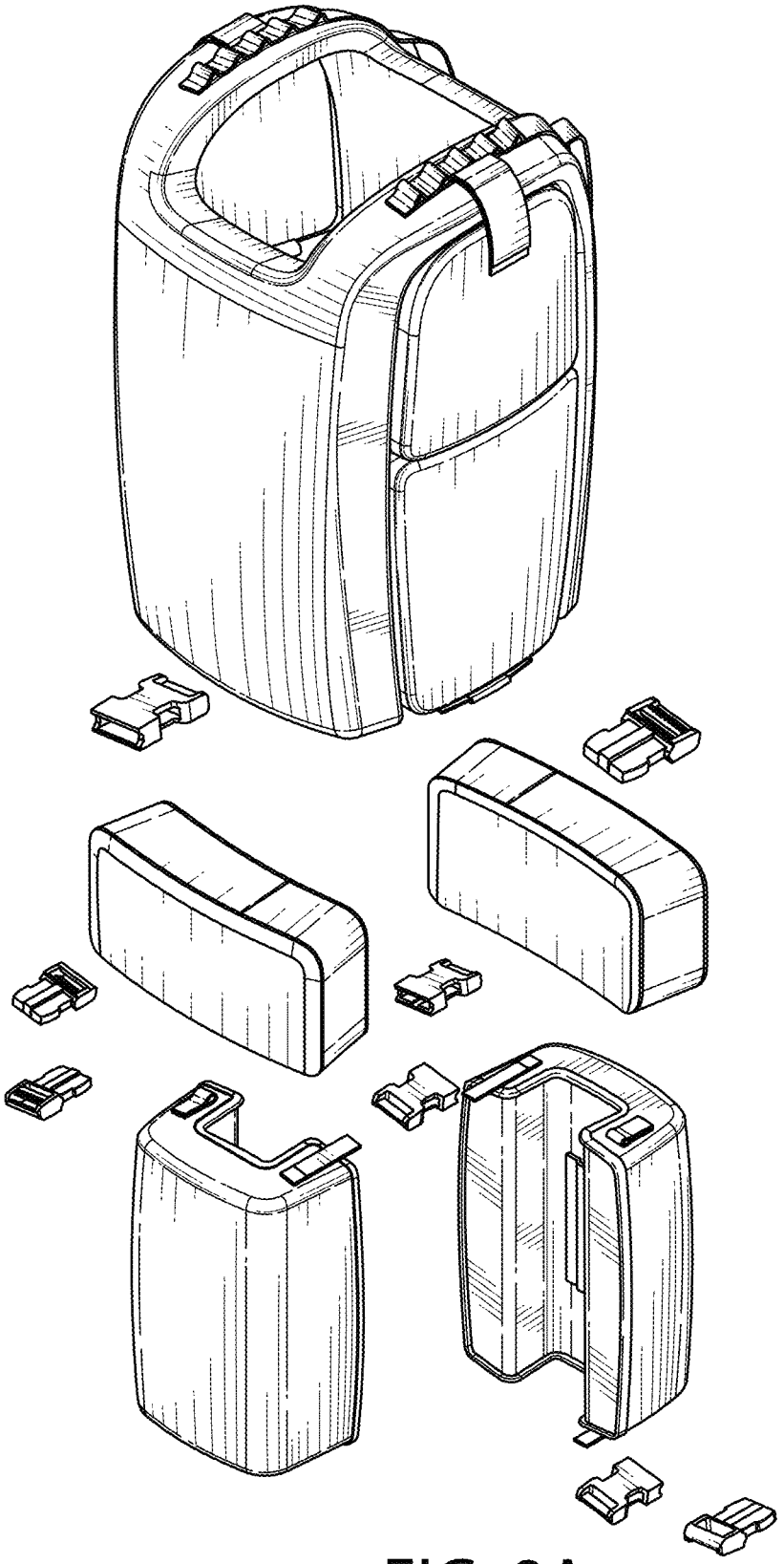
FIG. 8A is another exploded view of the punchwrap.

FIGS. 8 and 8A are an exploded view of the punchwrap 1000. As shown, hand pads 1200 and the arm pads 1300 are preferably disposed within the body padding 1100 of the punchwrap 1000. As shown in FIG. 8A, the hand pads and arm pads may be clipped into position within the body padding 1100. Other forms of attachment, like Velcro® (hook and loop fastener), snaps, buttons, zippers, or the like could also be used to secure the punchwrap 1000 into a punching bag configuration shown in FIGS. 1 through 7.

Figure 9:
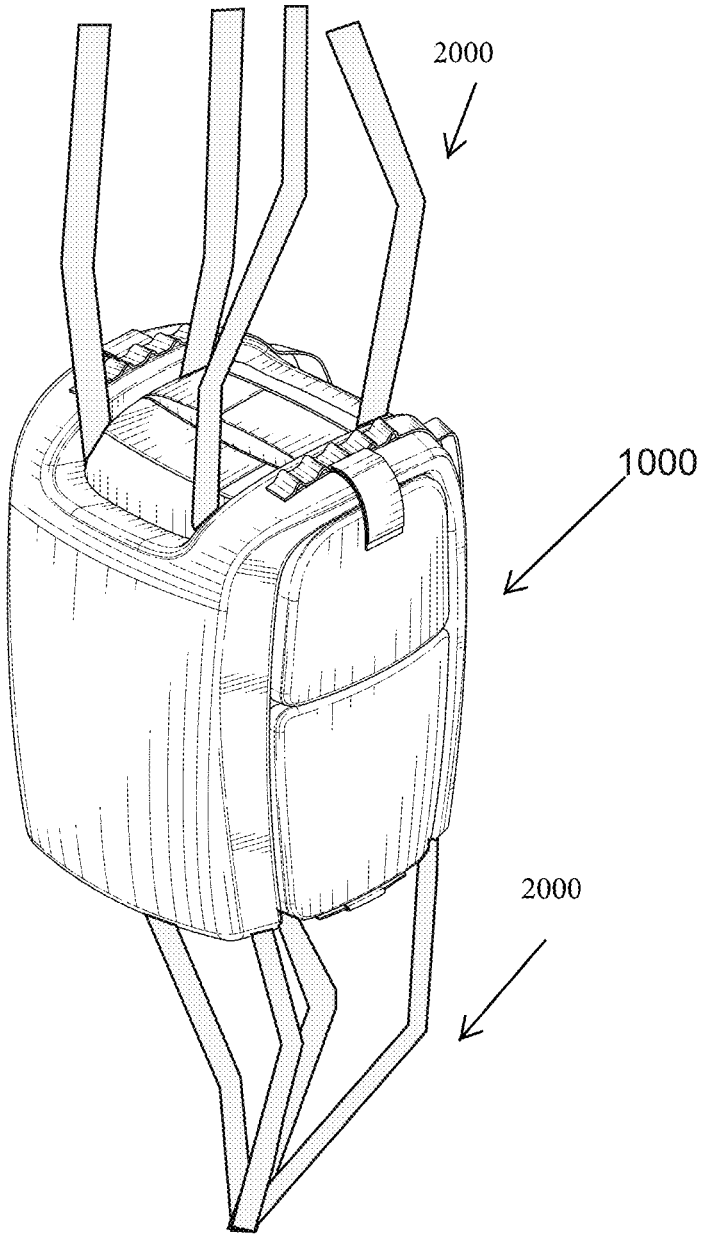
FIG. 9 is a perspective view of the punchwrap as a heavy bag.
Figure 10:
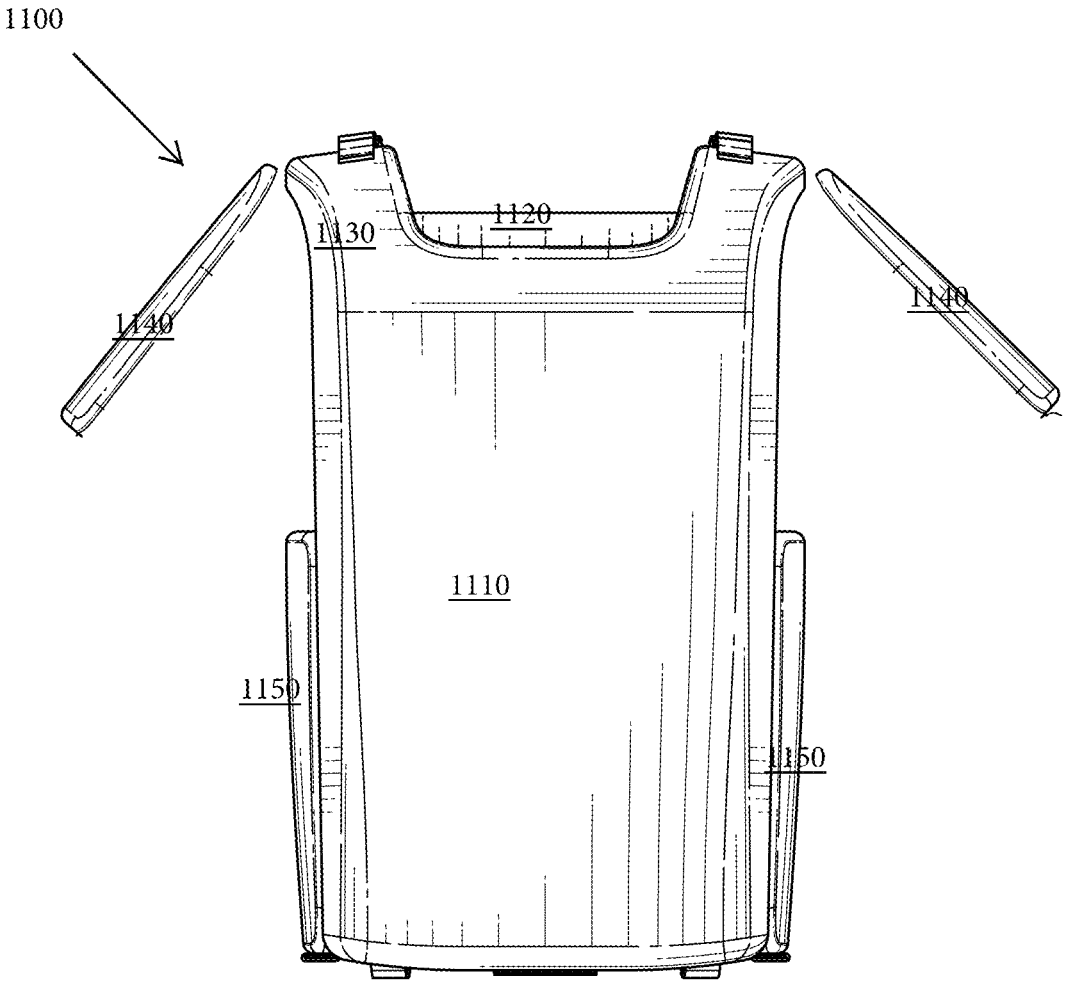

FIG. 9 is a perspective view of the punchwrap as a heavy bag. As shown, the punchwrap can be used as a heavy punching bag by securing cords 2000 to the upper loops 1131 of the shoulder straps 1131 and to the lower loops 1111, 1121 of the front and rear panels 1110, 1120. The cords 200 can be strung between a ceiling, the punchwrap 1000, and the floor. In one mode of use trainer may grip the handles 1122 to give it weight or tie or hook up or arm pads 1300 on the handles 1122 of the rear pad 1120. From this lifted position, the fighter may strike the punchwrap 1000 in the front 1110 or side panels 1150 using his feet or hands. Additionally, the fighter may punch arm padding 1300 that is exposed on the underside of the punchwrap 1000 (as shown in FIG. 7).

FIG. is 10 an environmental front view of how individual could wear the body padding 1100 as a training vest or body armor. As shown, the shoulder pads 1140 may be pivoted around the connector 1141 to form a shoulder pad and then a user could slip on the body padding 1100 like any shirt or jersey. The hand pads may be held in each hand for targeted punching while the arm padding can be worn on the forearms or shins of the trainer wearing the body harms. FIG. 11 is an exploded view of arm padding which is used to form the cylinder, as well as, a standalone item. FIG. 12 is a view of the assembled arm padding. As shown in FIG. 12, the arm padding forms a cylinder which may be used as a double ended punching bag. More specifically, the arm pads could be strung up with straps, as shown in FIGS. 12A through 12C, to accomplish a double ended punching bag.

Although the method and apparatus is described above in terms of various exemplary embodiments and implementations; it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A punching bag comprising:

body padding defined by:

a front panel with lower front loops;

side pads;

a rear panel with back straps and lower rear loops;

shoulder straps that connect the front and rear panels and that further feature upper loops; and shoulder pads hung off the straps via a connector;

wherein the body padding internally features hand pads and arm pads that are configured to be removably disposed between the front and rear pads where the hand and arm pads fit snugly inside the body padding.

* * * * *